US011125531B2

(12) United States Patent
Kjellberg

(10) Patent No.: US 11,125,531 B2
(45) Date of Patent: Sep. 21, 2021

(54) HOLSTER FOR CONCEALABLE FIREARM

(71) Applicant: Ideal Conceal Inc., Monticello, MN (US)

(72) Inventor: Kirk Kjellberg, Monticello, MN (US)

(73) Assignee: Ideal Conceal Inc., Monticello, MN (US)

( * ) Notice: Subject to any disclaimer, the term of this patent is extended or adjusted under 35 U.S.C. 154(b) by 0 days.

(21) Appl. No.: 16/597,690

(22) Filed: Oct. 9, 2019

(65) Prior Publication Data

US 2020/0326154 A1 Oct. 15, 2020

Related U.S. Application Data

(60) Provisional application No. 62/743,888, filed on Oct. 10, 2018.

(51) Int. Cl.
*F41C 33/02* (2006.01)
*F41C 33/04* (2006.01)
*F42B 39/02* (2006.01)

(52) U.S. Cl.
CPC ..... *F41C 33/048* (2013.01); *F41C 33/041* (2013.01); *F42B 39/02* (2013.01)

(58) Field of Classification Search
CPC ..... A45F 5/021; A45F 2200/0591; A45F 2200/0516; F41C 33/048; F41C 9/02; Y10S 224/93
USPC ..... 224/587, 242–243, 930
See application file for complete search history.

(56) References Cited

U.S. PATENT DOCUMENTS 1,381,301 A * 6/1921 Hargrave ..... A45C 15/00 109/36
5,528,770 A * 6/1996 Castilla ..... A45F 5/02 224/269
8,256,071 B2 * 9/2012 Okuda ..... G01C 22/006 24/517
8,910,839 B2 * 12/2014 Clifton ..... F41C 33/0209 224/243
9,027,814 B2 * 5/2015 Tages ..... A45F 5/021 224/666
9,078,498 B2 * 7/2015 Richardson ..... A45F 5/02
9,476,675 B1 * 10/2016 Mangios ..... F42B 39/02
10,159,330 B2 * 12/2018 Kovac ..... A45C 15/00
(Continued)

*Primary Examiner* — Adam J Waggenspack
(74) *Attorney, Agent, or Firm* — Winthrop & Weinstine, P.A.

(57) ABSTRACT

The present disclosure relates to novel and advantageous firearm holster. In particular, the present disclosure relates to a holster for a foldable or concealable firearms. A holster of the present disclosure may be configured to holster a firearm that has, or is foldable into, a generally rectangular shape. Such firearms may be sized, shaped, and configured to appear like a smartphone or other device. In other embodiments, the holster may be configured to accommodate other foldable or concealable firearms. The holster may allow a user to secure the firearm to her or his person, such as on a waistband, belt, or pocket ledge, for example. The holster may be configured such that a foldable firearm may be positioned therein in a folded or unfolded position. Moreover, the holster may allow a user to easily unfold a foldable firearm while the firearm is arranged in the holster. The holster may additionally be configured to allow a user to discharge the firearm while the firearm is arranged in the holster.

19 Claims, 8 Drawing Sheets

(56) References Cited

U.S. PATENT DOCUMENTS

| | | | | |
|---|---|---|---|---|
| 10,401,119 | B1 * | 9/2019 | Mathews | F41H 9/10 |
| 2009/0026239 | A1 * | 1/2009 | Chenel | F41A 23/34 224/401 |
| 2014/0027479 | A1 * | 1/2014 | Hogue | F41C 33/029 224/183 |
| 2015/0245700 | A1 * | 9/2015 | Merzon | A45F 5/021 224/245 |
| 2016/0025452 | A1 * | 1/2016 | Crye | F41C 33/048 224/587 |
| 2017/0205186 | A1 * | 7/2017 | Kjellberg | F41A 11/04 |

* cited by examiner

HOLSTER FOR CONCEALABLE FIREARM

FIELD OF THE INVENTION

The present disclosure relates to novel and advantageous firearm holsters. In particular, the present disclosure relates to a novel and advantageous holster for carrying a foldable and/or concealable firearm. More particularly, the present disclosure relates to a holster for carrying a handgun that is shaped and configured to look like a smartphone or similar shaped device.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

Figure 1:
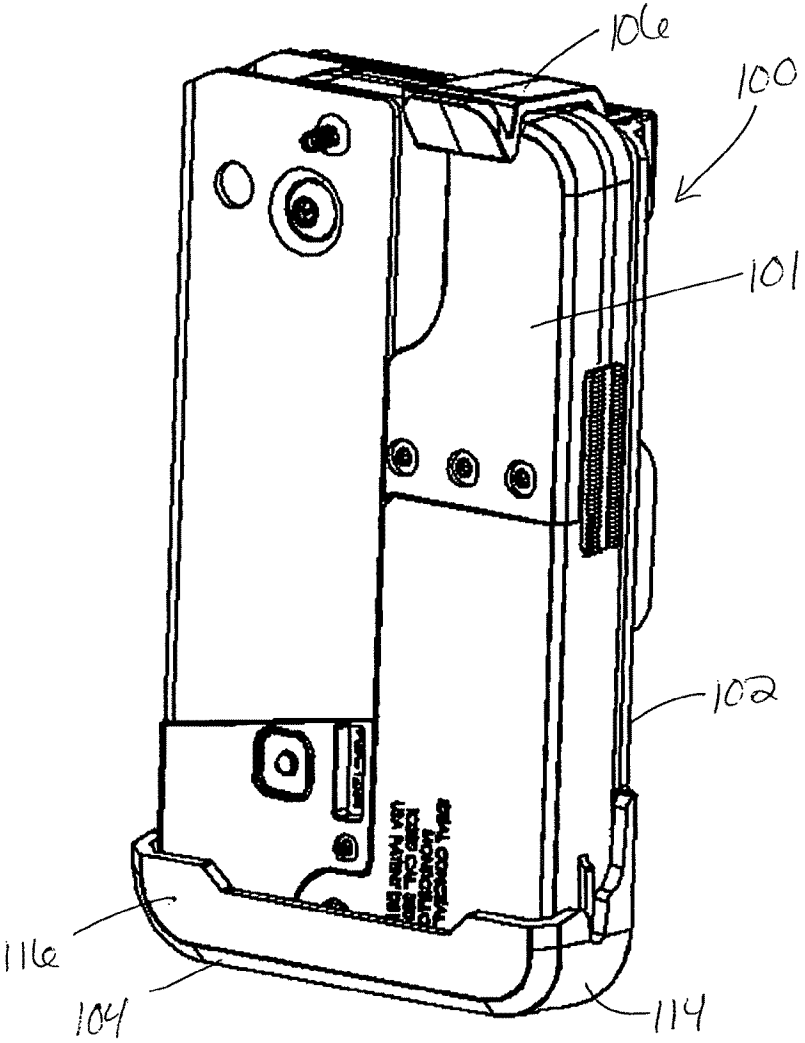
FIG. 1 is a front perspective view of a holster of the present disclosure with a concealable firearm arranged therein, according to one or more embodiments.
Figure 2:
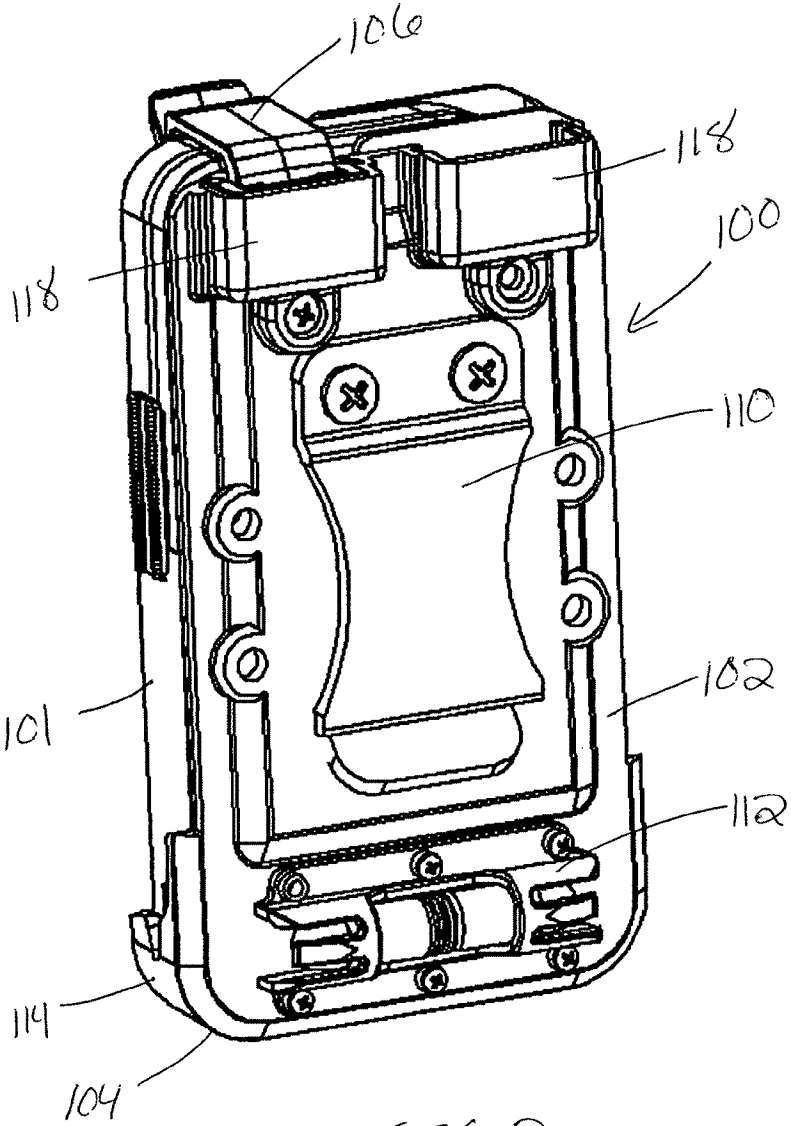
FIG. 2 is a rear perspective view of a holster of the holster and concealable firearm of FIG. 1, according to one or more embodiments.
Figure 3:
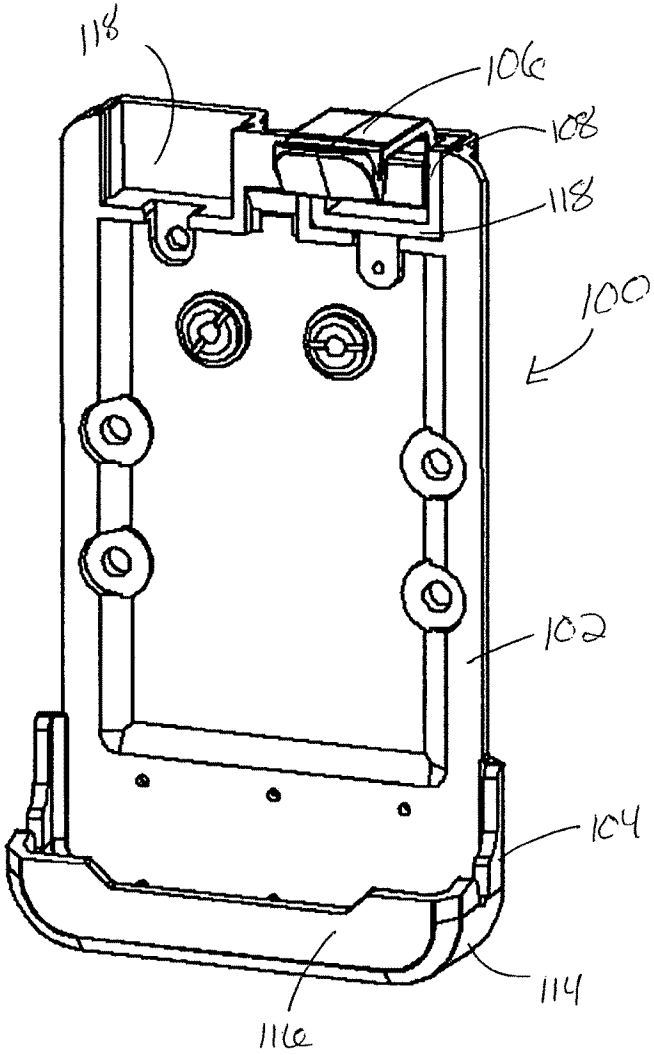
FIG. 3 is a front perspective view of the holster of FIG. 1, according to one or more embodiments.

The present disclosure relates to novel and advantageous firearm holster. In particular, the present disclosure relates to a holster for a foldable or concealable firearm, such as the firearms described in U.S. patent application Ser. No. 15/259,857, entitled Concealable Firearm, and filed Sep. 8, 2016, the content of which is hereby incorporated by reference herein in its entirety. In this way, a holster of the present disclosure may be configured to holster a firearm that has, or is foldable into, a generally rectangular shape. Such firearms may be sized, shaped, and configured to appear like a smartphone or other device. In other embodiments, the holster may be configured to accommodate other foldable or concealable firearms. The holster may allow a user to secure the firearm to her or his person, such as on a waistband, belt, or pocket ledge, for example. Additionally, and as described below, the holster may be configurable such that a user may wear or position the firearm in an upright position, side position, and/or on a left or right side of the user's body. The holster may be configured such that a foldable firearm may be positioned therein in a folded or unfolded position. Moreover, the holster may allow a user to easily unfold a foldable firearm while the firearm is arranged in the holster. The holster may additionally be configured to allow a user to discharge the firearm while the firearm is arranged in the holster.

FIGS. 1-7 show a firearm holster 100 of the present disclosure, according to one or more embodiments. The firearm holster 100 may generally have a back wall portion 102, a lower shoe portion 104, a firearm securing clip 106, a clip engaging portion 108, a holster attachment clip 110, and an ammunition holder 112. Components of the holster 100 may be constructed of one or more plastics, metals, and/or other suitable materials.

The back wall portion 102 may provide a surface configured to be arranged against or along a side surface of the concealable firearm 101 when the firearm is positioned in the holster 100. The back wall portion 102 may be sized and shaped similar a side of the firearm 101. For example, the back wall portion 102 may have a rectangular shape, and in some embodiments, may have four rounded corners. The back wall portion 102 may have a length extending between approximately 3 inches and approximately 8 inches, or between approximately 5 inches and approximately 7 inches. The back wall portion 102 may have a width perpendicular to the length and extending between approximately 1.5 inches and approximately 5 inches, or between approximately 2 inches and approximately 3 inches. The back wall portion 102 may have a thickness perpendicular to the length and width of less than 0.5 inches, less than 0.25 inches, or less than 0.1 inches in some embodiments. In other embodiments, the back wall portion 102 may have any other suitable shape and dimensions.

The back wall portion 102 may further be configured to provide support for the additional structures and portions of the holster 100. In some embodiments, the back wall portion 102 may have a reinforced portion having a larger thickness than other portions of the back wall. For example, the back wall portion 102 may have a reinforced portion at or surrounding a location where the holster attachment clip 110 and/or clip engaging portion 108 couple to the back wall portion. In some embodiments, the back wall portion 102 may have a recessed area at or surrounding where the attachment clip 110 and/or clip engaging portion 108 couple to the back wall portion. The recessed area may be recessed on the surface of the back wall portion 102 that is configured to face the firearm 101 and may extend outward on an opposing surface of the back wall portion, such as where the attachment clip 110 is coupled. This may allow screws for the attachment clip 110 and/or other components to extend through the back wall portion 102 without harming or interfering with the firearm 101.

The shoe portion 104 may extend from the back wall portion 102 and may be configured to wrap around or hug a side edge of the concealable firearm 101. The shoe portion 104 may generally include a sidewall portion 114 and a front wall portion 116. The sidewall portion 114 may extend from a side or edge of the back wall portion 102. For example, where the back wall portion 102 has a rectangular shape with two short edges and two long edges, the sidewall 114 may extend from one of the short edges. The sidewall 114 may extend to a depth configured to accommodate a depth of the concealable firearm 101. The sidewall 114 may additionally be configured to wrap around two corners of the concealable firearm 101, or at least a portion thereof, as shown for example in FIG. 1. In this way, a portion of the sidewall 114 may extend from each of the two long sides of a rectangular-shaped back wall portion 102. The front wall 116 portion may extend from the sidewall portion 114 and may be configured to be arranged adjacent or against a side of the concealable firearm 101. As shown for example in FIG. 1, in this way, the sidewall portion 114 and front wall portion 116 may be configured to help hold the concealable firearm 101 in the holster 100 and against or adjacent the back wall portion 102.

Figure 5:
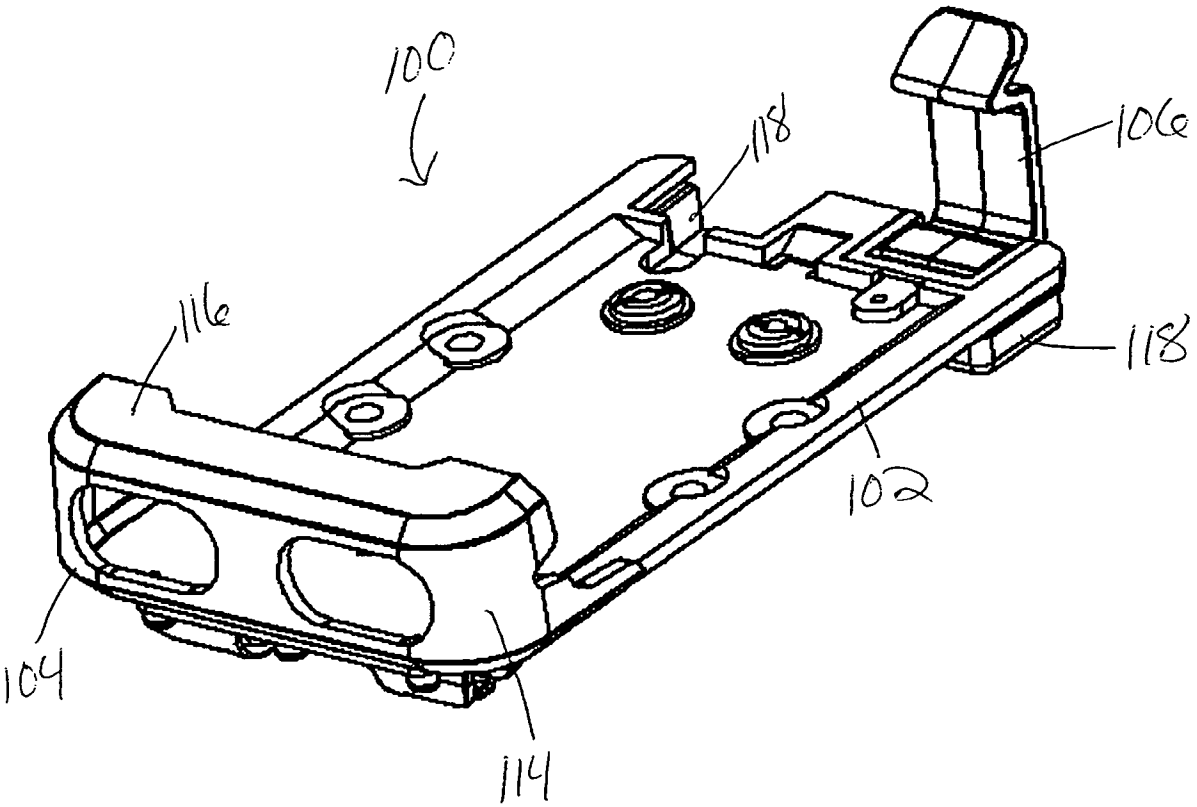
FIG. 5 is an end perspective view of the holster of FIG. 1, according to one or more embodiments.

In some embodiments, the shoe portion 104 may have one or more openings therein. For example, and as shown in FIG. 5, the sidewall 114 of the shoe portion 104 may have one or more openings. In some embodiments, the opening(s) may be configured to align with a barrel of the firearm 101, such that an ammunition round fired from the firearm may be directed through the opening(s). In this way, the holster 100 may be configured such that the firearm 101 may be fired while otherwise positioned or secured in the holster.

In addition to the shoe portion 104, the firearm securing clip 106 may also be configured to help hold the concealable firearm 101 in the holster 100 and against or adjacent the back wall portion 102. The firearm securing clip 106 may have an attachment portion, a firearm securing portion, and a tab portion. The attachment portion may generally be configured to couple the clip to another portion of the holster 100. In some embodiments, the attachment portion may couple directly to the back wall portion 102 or to another portion of the holster 100. In some embodiments, the attachment portion may be configured to rotatably or pivotably couple to the holster 100. For example, the attachment portion may have two wings configured to engage a bar or ledge, such that the attachment portion may pivot about the bar or ledge. In some embodiments, the clip 106 may be configured to pivot between a first position and a second position, which may be an open position and a closed position. In the closed position, the clip 106 may generally hold the firearm 101 within the holster 100. In the open position, the clip 106 may generally allow a user to withdraw the firearm 101 from the holster 100, or to position the firearm within the holster. In some embodiments, one or more springs may operate to bias the clip 106 in the closed position to help maintain a firearm 101 securely in the holster 100. The firearm securing portion of the clip 106 may extend from the attachment portion and may be configured to extend over or around an edge or side of the firearm 101. The tab portion of the clip 106 may be configured to allow a user to pivot the clip. The firearm securing clip 106 may be arranged on or over an edge of the firearm 101, opposite the edge arranged in the shoe portion 104. In this way, the clip 106 may generally help to position the firearm 101 between the shoe portion 104 and the clip.

In some embodiments, the firearm securing clip 106 may couple to a clip engaging portion 108. For example, the clip engaging portion 108 may provide a bar or ledge or other component about which the firearm securing clip 106 may pivot. The clip engaging portion 108 may provide a housing for the bar or ledge. The clip engaging portion 108 may couple to the back wall portion 102 via one or more screws or other suitable attachment mechanisms. In some embodiments, the back wall portion 102 of the holster may have a recessed housing 118 configured to receive the firearm securing clip 106 and/or clip engaging portion 108. Where the firearm 101 is a foldable firearm, such as those described in U.S. application Ser. No. 15/259,857, previously incorporated herein by reference, it is to be appreciated that the firearm securing clip 106 and/or clip engaging portion 108 may be arranged on the holster 100 so as not to interfere with movement of the firearm handle. In this way, the holster 100 may be configured such that a user may unfold or fold the firearm 101 while it is arranged in the holster.

In some embodiments, the holster 100 may have a holster attachment clip 110 coupled to the back wall portion 102. The attachment clip 110 may be configured to be positioned over or on a user's belt, waistband, pocket ledge, or other suitable location. The attachment clip 110 may be or include an elongated and generally flattened shape. The attachment clip 110 may couple to the back wall portion 102 at a first end of the attachment clip, and may have a tab arranged at a second end opposing the first end. In this way, the clip 110 may be configured such that a user may generally slide a belt or waistband beneath the second end, such that the belt or waistband may be positioned between the clip and the back wall portion 102. In some embodiments, the clip 110 may have a slightly curved or arched shape, curving outward away from the back wall portion between the first and second ends.

In some embodiments, the holster 100 may have an ammunition holder 112. The holder 100 may be coupled to the back wall portion 102, for example. In other embodiments, the ammunition holder 112 may be coupled or affixed to a different component or location of the holster 100. The ammunition holder 112 may be sized and shaped to hold one, two, three, or more rounds of ammunition. In some embodiments, the ammunition holder 112 may have a generally arced shape, so as to wrap around cylindrically shaped ammunition rounds. The holder 112 may be configured to arrange the ammunition rounds between the holder and the back wall portion 102. In some embodiments, the ammunition holder 112 may have one or more openings so as to allow a user to view whether there are ammunition rounds in the holder, and additionally to allow for better access to the rounds. The ammunition holder 112 may additionally have one or more tabs configured to be pushed and/or pulled so as to allow a user access to the ammunition rounds. The ammunition holder 112 may couple to the back wall portion 102 via one or more screws or any other suitable attachment mechanisms.

Figure 4:
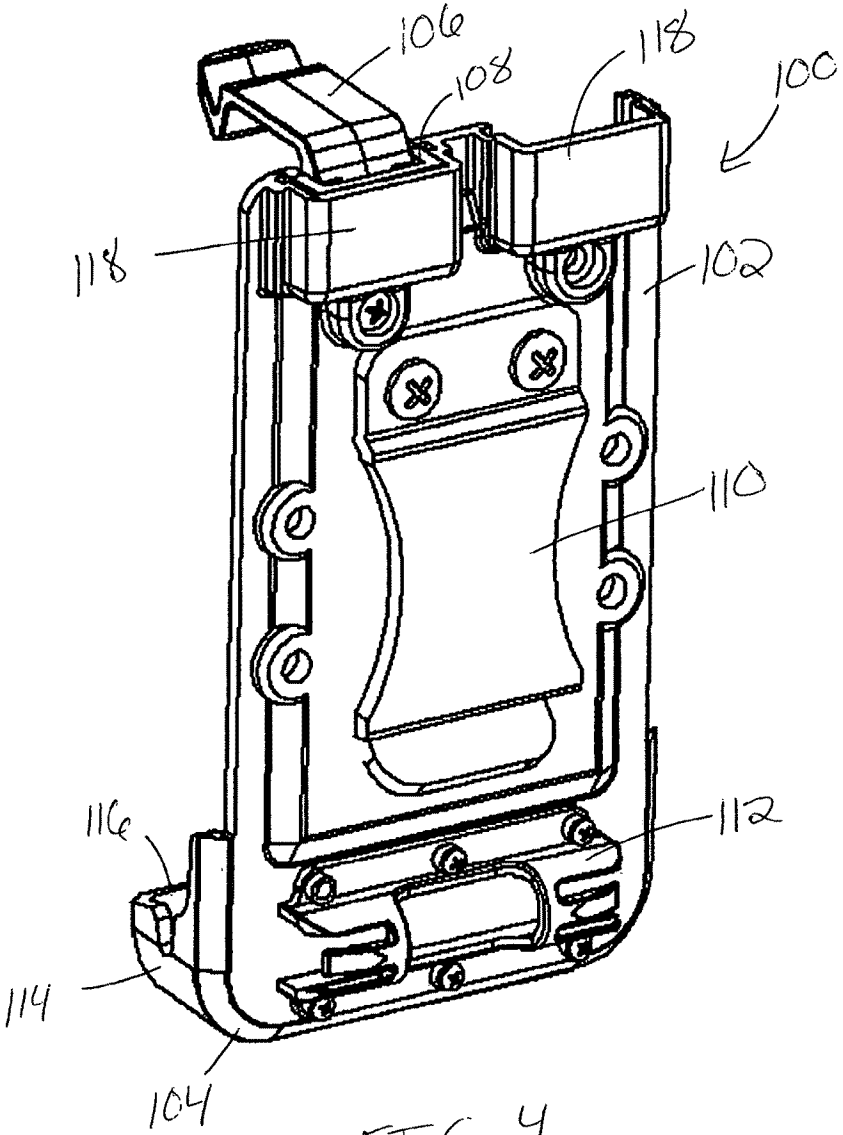
FIG. 4 is a rear perspective view of the holster of FIG. 1, according to one or more embodiments.
Figure 6:
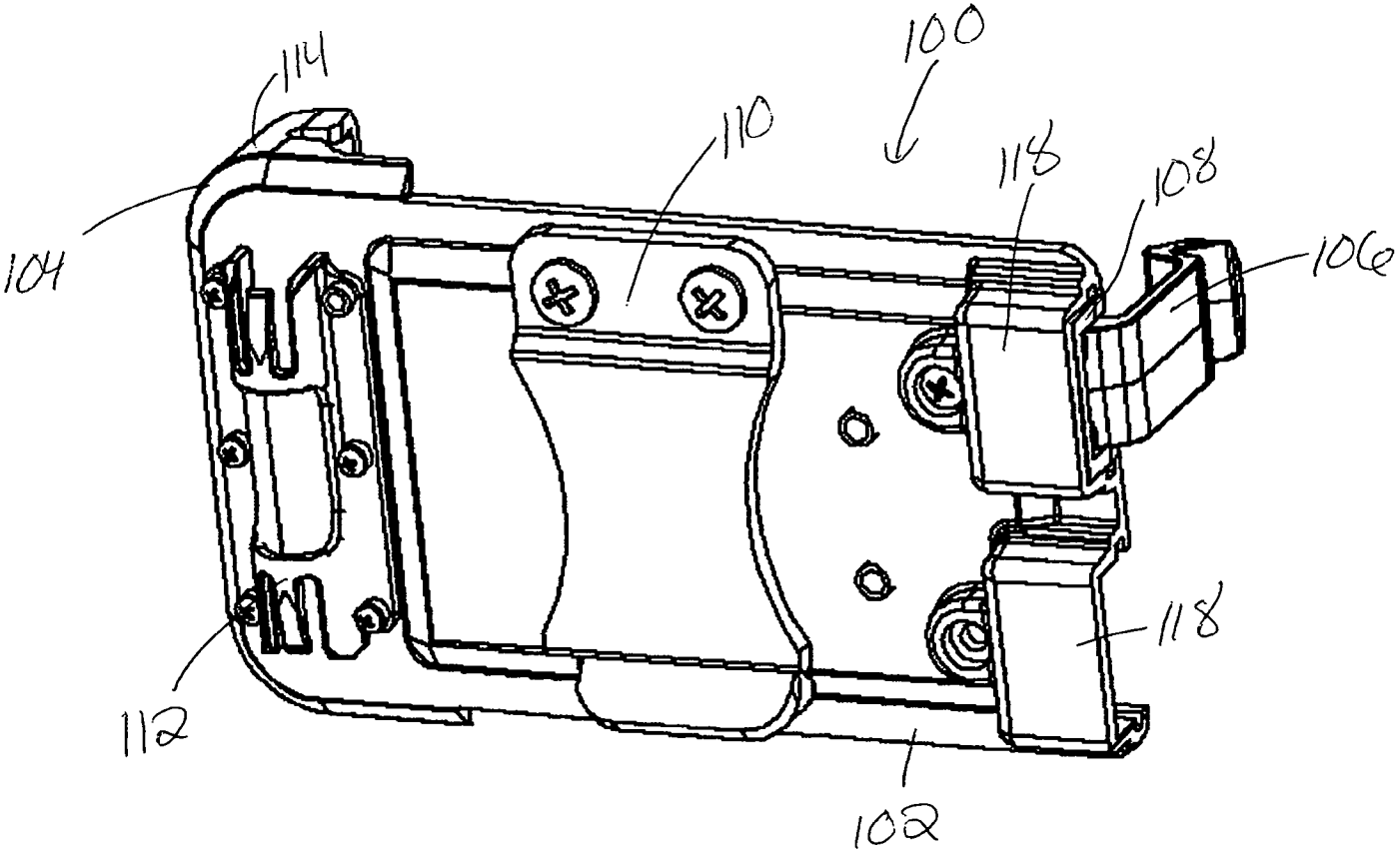
FIG. 6 is a rear perspective view of the holster of FIG. 1 with the attachment clip arranged in a different configuration, according to one or more embodiments.
Figure 7:
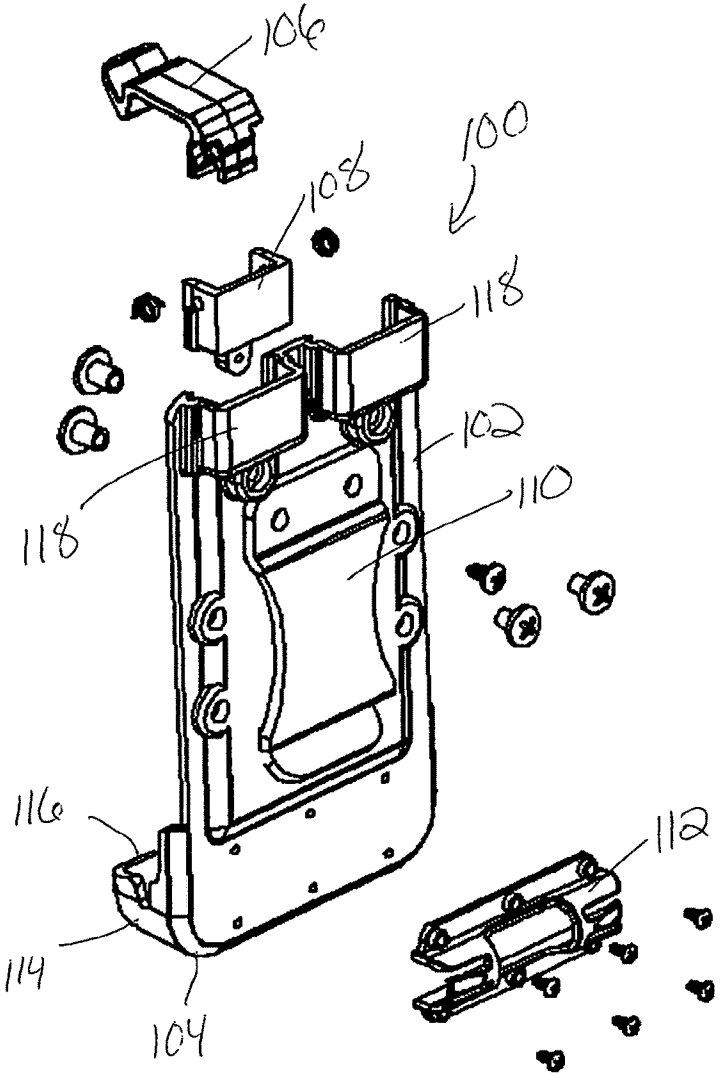
FIG. 7 is an exploded view of the holster of FIG. 1, according to one or more embodiments.

In some embodiments, the holster 100 may generally be configurable in various ways. For example, The holster 100 may be configured to be worn or used in a first or upright configuration, such that when a user positions the holster over a belt or waistband, for example, the firearm 101 may be positioned in the holster with the barrel generally pointed downward toward and perpendicular to a ground surface. In the upright configuration, the holster attachment clip 110 may be arranged in an upright position, as shown in FIG. 4. Additionally, the holster 100 may be configured to be worn in a second or side configuration, such that when a user positions the holster over a belt or waistband, for example, the firearm 101 may be positioned in the holster with the barrel generally pointed in a direction parallel with the ground surface. In the side configuration, the holster attachment clip 110 may be arranged in a side position, as shown in FIG. 6. In this configuration, a user may be able to generally aim toward a target and discharge the firearm 101 while it is positioned in the holster 100. To provide for this configurability, the attachment clip 110 may be removable, such that a user may reposition the clip between an upright position and a side position, depending on how the user wishes to wear or use the holster 100. In some embodiments, the back wall portion 102 may have multiple openings or sets of openings to accommodate different screw locations based on the desired position of the attachment clip 110.

Additionally, the holster 100 may be configurable in that it may be ambidextrous. That is, a user may configure the holster 100 to wear it on either the left side or the right side of the user's body. To provide for this configurability, the firearm securing clip 106 and engaging portion 108 may be movable. For example, the back wall portion 102 may have two recessed housings 118 and two corresponding screw openings configured to receive the engaging portion 108 and securing clip 106 in either a first configuration or a second configuration. Additionally, the holster 100 may be configured such that the attachment clip 110 may be arranged in either of two side configurations to accommodate a left side or a right side body placement. Moreover, the shoe portion 104 may have two openings, so as to accommodate the barrel of the firearm 101 whether the barrel is positioned on a first side or second side of the holster 100.

Figure 8:
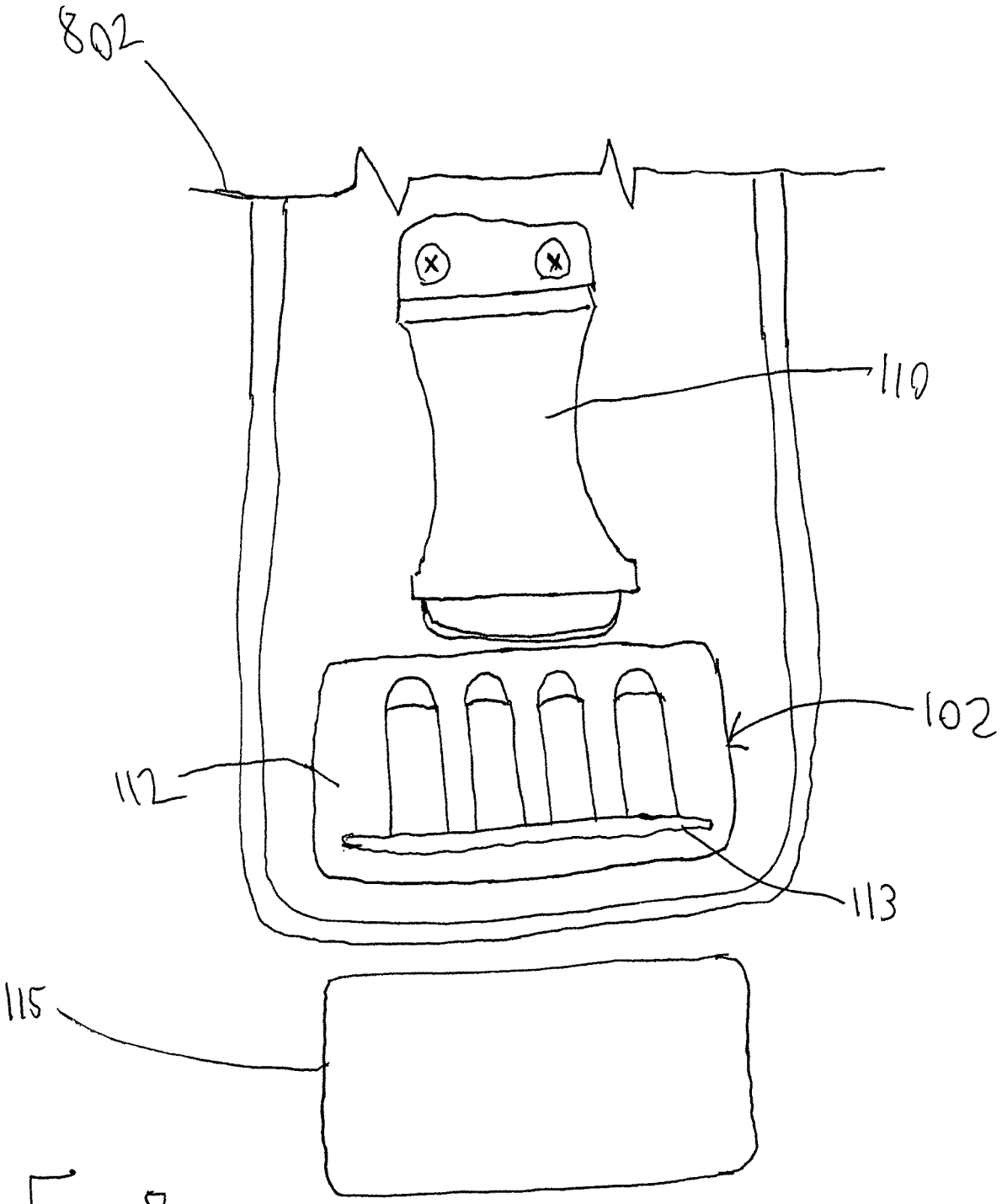
FIG. 8 is a rear view of the lower portion of the holster of FIG. 1, according to one or more embodiments.

As shown in FIG. 8, in some embodiments, ammunition holder 112 may comprise a holding mechanism for a quick-strip or speedloader device 113 for holding ammunition. The speedloader device 113 may be used to allow for fast loading of firearm 101, or any other firearm. The speedloader device 113 may be sized and shaped to hold one or more rounds of ammunition. In some embodiments, speedloader device 113 may hold between four and six rounds of ammunition. The speedloader device 113 may be secured to the back wall portion 102 via any suitable attachment mechanisms, including but not limited to screws, press-fit, clips, and the like. Speedloader device 113 may also include a cover 115 for securing and containing the speedloader device 113 and any ammunition. Cover 115 may fit over and secure speedloader device 113 to holster 100, and may further protect the ammunition from dust and debris. Cover 115 may be secured to back wall portion 102 or another suitable portion of holster 100 by any suitable attachment means. Break line 802 is included to illustrate that only the lower portion of holster 100 is shown in FIG. 8.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

Additionally, as used herein, the phrase "at least one of [X] and [Y]," where X and Y are different components that may be included in an embodiment of the present disclosure, means that the embodiment could include component X without component Y, the embodiment could include the component Y without component X, or the embodiment could include both components X and Y. Similarly, when used with respect to three or more components, such as "at least one of [X], [Y], and [Z]," the phrase means that the embodiment could include any one of the three or more components, any combination or sub-combination of any of the components, or all of the components.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A firearm holster for holstering a firearm, the firearm holster comprising:

a back wall portion;

a shoe portion extending from the back wall portion and configured to receive a first edge of the firearm when the firearm is holstered, the shoe portion comprising an opening configured to align with a barrel of the holstered firearm, such that the firearm may be fired while in the holster;

a movable firearm securing clip configured to extend over a second edge of the firearm and be positioned in a first configuration or a second configuration;

first and second recessed housings in the back wall portion wherein the movable firearm securing clip is in the first configuration when received by the first recessed housing and is in the second configuration when received by the second recessed housing; and a configurable attachment clip configured for being arranged in an upright configuration or second side configuration.

2. The firearm holster of claim 1, wherein the firearm holster is configured such that, upon holstering of the firearm, a side surface of the firearm is arranged against the back wall portion.

3. The firearm holster of claim 1, wherein the shoe portion includes a sidewall portion and a front wall portion.

4. The firearm holster of claim 3, wherein the back wall portion has a rectangular shape with two short edges and two long edges, and wherein the sidewall extends from one of the short edges.

5. The firearm holster of claim 1, wherein the firearm securing clip includes two wings configured to engage a bar such that the firearm securing clip may pivot about the bar.

6. The firearm holster of claim 1, wherein the firearm securing clip pivots between a closed position wherein the firearm securing clip holds the firearm in the holster and an open position wherein the firearm securing clip generally allows a user to withdrawn the firearm from the holster or to position the firearm within the holster.

7. A firearm holster for holstering a firearm, the firearm holster comprising:

a back wall portion having an inner surface configured to face the firearm when the firearm is holstered;

a shoe portion, wherein the shoe portion extends from the back wall portion and is configured to wrap around a side edge of the firearm when the firearm is holstered;

first and second recessed housings in the back wall;

a movable firearm securing clip, wherein the firearm securing clip may be moved between a first configuration and a second configuration;

a clip engaging portion, the clip engaging portion being coupled to the back wall, wherein the movable firearms securing clip is in the first configuration when the clip engaging portion is coupled to the first recessed housing in the back wall at a first position and the movable firearm securing clip is in the second configuration when the clip engaging portion is coupled to the second recessed housing in the back wall at a second position; and a holster attachment clip, the holster attachment clip being coupled to the back wall portion.

8. The firearm holster of claim 7, further comprising an ammunition holder.

9. The firearm holster of claim 8, wherein the ammunition holder is configured to arrange the ammunition rounds between the ammunition holder and the back wall portion.

10. The firearm holster of claim 8, wherein the ammunition holder is a speedloader device.

11. The firearm holster of claim 7, wherein the back wall portion has a recessed area at or surrounding where the attachment clip couples to the back wall portion.

12. The firearm holster of claim 7, wherein the back wall portion has a recessed area at or surrounding where the clip engaging portion couples to the back wall portion.

13. The firearm holster of claim 12, wherein the recessed area is on the inner surface and extends outwardly on an opposing surface of the back wall portion.

14. The firearm holster of claim 7, wherein the shoe portion includes a sidewall portion and a front wall portion.

15. The firearm holster of claim 14, wherein the back wall portion has a rectangular shape with two short edges and two long edges, and wherein the sidewall extends from one of the short edges.

16. The firearm holster of claim 7, wherein the shoe portion has an opening therein.

17. The firearm holster of claim 16, wherein the opening is configured to align with a barrel of the firearm when the firearm is holstered such that an ammunition round fired from the holstered firearm may be directed through the opening.

18. A firearm holster for holstering a firearm, the firearm holster comprising:

a back wall portion having an inner surface configured to face the firearm when the firearm is holstered, the back wall portion having a rectangular shape with two short edges and two long edges;

a shoe portion, wherein the shoe portion extends from the back wall portion and is configured to wrap around a side edge of the firearm when the firearm is holstered, wherein the shoe portion includes a sidewall portion and the sidewall extends from one of the short edges of the back wall portion, wherein the shoe portion has two openings to align with a barrel of the holstered firearm whether the barrel is positioned on a first side or a second side of the holster; and a holster attachment clip, the holster attachment clip being coupled to the back wall portion, wherein the attachment clip may be arranged in either of two side configurations to accommodate a left side or a right side body placement first and second recessed housings in the back wall; a movable firearm securing clip that can take on a first configuration when coupled to the first recessed housing and a second configuration when coupled to the second recessed housing to secure the firearm in the holster.

19. The firearm holster of claim 18, further comprising a firearm securing clip configured to help hold the firearm in the holster and against the back wall portion, wherein the firearm securing clip includes an attachment portion, a firearm securing portion, and a tab portion.

* * * * *